United States Patent [19]

Herman et al.

[11] Patent Number: 4,704,298

[45] Date of Patent: Nov. 3, 1987

[54] COATING SPHERICAL OBJECTS

[75] Inventors: Herbert Herman, Port Jefferson; Gary S. Fischman, St. James; Glenn A. Bancke, Syosset, all of N.Y.

[73] Assignee: The Research Foundation of State University of New York, Albany, N.Y.

[21] Appl. No.: 892,194

[22] Filed: Jul. 31, 1986

[51] Int. Cl.[4] ..... B05D 13/06

[52] U.S. Cl. ..... 427/34; 427/303; 427/304; 29/148.4 B

[58] Field of Search ..... 427/34, 38; 29/148.4 B

[56] References Cited

U.S. PATENT DOCUMENTS

| | | | |
|---|---|---|---|
| 999,789 | 8/1911 | Hussey . | |
| 2,369,592 | 2/1945 | Marinsky et al. | 112/251 |
| 2,691,306 | 10/1954 | Beams et al. | 74/5.6 |
| 2,833,241 | 5/1958 | Crowley et al. | 118/62 |
| 2,883,959 | 4/1959 | Rodriguez | 118/49 |
| 3,112,220 | 11/1963 | Heiser et al. | 117/100 |
| 3,141,792 | 7/1964 | Lachman et al. | 118/6 |
| 3,241,520 | 3/1966 | Wurster et al. | 118/62 |
| 3,500,792 | 3/1970 | Brockett | 118/416 |
| 3,517,644 | 6/1970 | Baer | 118/49 |
| 3,677,807 | 7/1972 | Curtis et al. | 428/404 |
| 3,687,717 | 8/1972 | Philip | 117/100 A |
| 3,707,136 | 12/1972 | Kostas | 118/303 |
| 3,880,116 | 4/1975 | Prillig et al. | 118/303 |
| 3,936,295 | 2/1976 | Cromwell et al. | 75/0.5 R |
| 3,961,098 | 6/1976 | Bessen | 427/34 |
| 4,196,231 | 4/1980 | Hubers | 427/240 |
| 4,238,526 | 12/1980 | Chitouras | 427/44 |
| 4,286,541 | 9/1981 | Blackwood | 118/52 |
| 4,311,111 | 1/1982 | Inaba et al. | 118/56 |
| 4,312,292 | 1/1982 | Smith et al. | 118/320 |
| 4,526,839 | 2/1985 | Herman et al. | 428/550 |
| 4,536,640 | 8/1985 | Vukanovic | 219/121 PR |

*Primary Examiner*—Thurman K. Page
*Assistant Examiner*—Leon R. Horne
*Attorney, Agent, or Firm*—Hoffman, Dilworth, Barrese & Baron

[57] ABSTRACT

Method and apparatus for coating ball bearings and like spherically shaped objects with a coating composition entrained in a plasma jet, the ball bearings being held captured in an open-sided cage during the coating operation.

18 Claims, 5 Drawing Figures

Fig. 2a
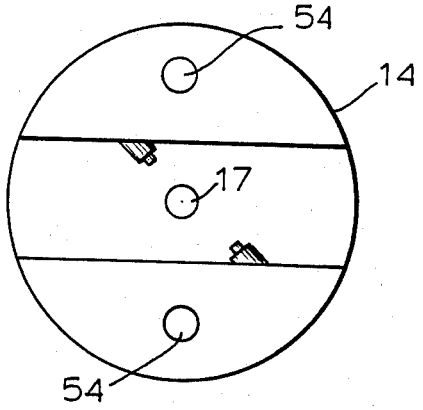
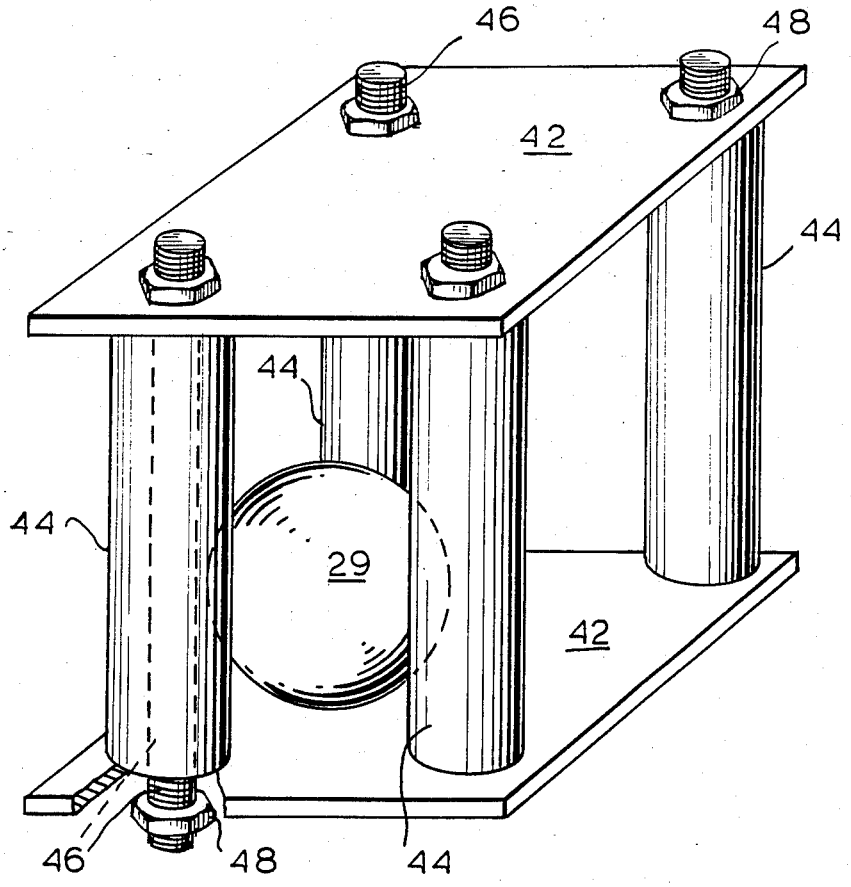
Fig. 3

COATING SPHERICAL OBJECTS

BACKGROUND OF THE INVENTION

It is known to coat spherical and like-shaped objects with various materials and for various purposes. For example, U.S. Pat. No. 2,833,241 discloses painting golf balls while same are levitated or suspended in an upwardly flowing airstream; and U.S. Pat. Nos. 3,112,220; 3,241,520 and 3,880,116 discloses coating pharmaceutical products with protective coatings in fluidized beds of upwardly flowing air, the coating materials being, e.g., sprayed upwardly through the bed in the fluidized airstream. It also is known to coat non-spherical articles to enhance resistance to corrosion (U.S. Pat. No. 3,961,098) and to coat articles such as piston rings by plasma arc technique to enhance the wear surfaces of the rings (U.S. Pat. No. 3,936,295). Holding various shaped articles to be coated, such as with paint or other materials in a rotating receptacle is known from, inter alia, U.S. Pat. Nos. 4,311,111 and 3,517,644.

One form of spherical objects to which it would be particularly desirable to apply an anti-wear and/or anti-corrosive coatings as well as thermally insulative coatings are ball bearings, especially ferrous based material ball bearings. Techniques as exemplified by the aforementioned prior art and such other methods as are known to us by which material coatings can be applied to various shaped objects would not be satisfactory for coating a ball bearing both from the standpoint of acceptable coating uniformity and application of such coatings without leaving a coating edge residue on the ball. Presence of an edge on the coating of a ball bearing is unsatisfactory in that the edge is an access point for corrosive attack on the ball structure and for the initiation of mechanical deterioration.

SUMMARY OF THE PRESENT INVENTION

The present invention provides a method and an apparatus with which ball bearings can with reasonable uniformity both as to surface covering and coating depth, be coated with materials exhibiting anti-wear and/or anti-corrosion characteristics, such coatings including oxides of metals, ceramic oxides and nickel based alloys as well as others, the coatings also including ones which serve to protect the bearing substrate from high temperatures where the bearing is employed in high temperature operating environments. The coating can be applied with a thermal spraying operation such as, plasma jet, flame, electric arc or hyper velocity flow techniques, the plasma jet spraying being particularly suitable.

For applying the coating to the ball bearing it is captively held in a relatively open-sided cage which presents an object free-movement space of defined three-dimensional expanse. As a preliminary step before the coating operation is begun, the ball bearing may be subjected to a surface treatment operation such as a grit-blasting thereof to roughen the ball surface and thereby to enhance the adherence of the applied coating to such surface. To effect coating, a plasma jet in which the coating material has been entrained in known manner is directed into the cage, the cage being rapidly rotated about a fixed vertical axis. The highly heated jet plasma stream ionized gas flow conveys the entrained coating material which becomes molten in the plasma jet, onto the captive ball whereon the impacting coating spreads and solidifies. Desirably, and at the same time, a flow of cooling gas can be directed into the rotating cage and onto the ball to prevent it from overheating. This flow of cooling gas preferably is directed upwardly from a location below the rotating cage and issues from a location spaced about 90° relative to the location from which the plasma jet issues and as related to the fixed vertical axis. The combined action of the rotating cage and the high velocity plasma jet stream gas and coating material flow results in imparting momentum, and particularly levitative momentum, to the ball causing the ball to move about the cage in a tumbling, rebounding and self-rotating travel within the cage free-movement space, the movement being in random paths during the whole time the coating is being applied, the high velocity cooling gas flow also contributing to a certain degree in creation of the forementioned movement phenomena. The free-movement of the ball is such that the entire outer surface of the ball becomes exposed to the plasma jet flow and in such a way that a reasonable uniformity of coating application takes place. The random movement of the ball is created by the particular arrangement of rotational forces consequent from the cage movement, the plasma jet and coating flow, principally, and the cooling gas flow, subsidiarily, which tends to levitate the ball within the cage. During the coating operation, the plasma jet can be moved up and down vertically with respect to the cage to enhance the covering of the entire ball outer surface. After a desired thickness of ball coating, e.g., one in a range of about 0.004 to about 0.015 inch has been achieved, the plasma jet can be terminated while the cooling gas flow can be maintained to cool down the coated bearing and the cage structure.

Additional cooling streams can be issued from the plasma jet torch codirectionally with the plasma jet flow to modulate the plasma jet and to further cool the ball to prevent overheating of same. Overheating of the ball can cause flashing of the coating material when it strikes the ball rather than allowing it to rapidly solidify and build a uniform coating in the intended manner.

The spacing of the plasma jet torch from the cage, the vertical movement speed thereof the and cage rotary speed can be controlled for any given coating operation. Also and depending on the type of coating material, the coating operation can be carried out in a vacuum, a controlled environment, e.g., inert gas environment or ambient air environment.

The cage in which the ball is received can conveniently be provided as a multi-open sided structure in which upper and lower plates are intervened by a plurality of parallel posts spaced around the expanse of the plates adjacent the peripheries thereof, the spacing being less than the diameter of the ball being coated. The posts, which are, in general, loosely filling refractory ceramic tubing can be mounted to be rotatable relative to the plates to contribute to the rebound spin provided to the ball as when same in its random movement course strikes a post.

The invention provides that only one ball per cage be coated in an operation. If it is desired to coat more than one, a corresponding number of cages will be provided and be arranged in stacked vertical positioning one on the other with the respective cage sides aligned in vertical register.

The advantages and further features of the invention will be made more apparent from the following detailed description to be given hereinafter and will be described in terms of such method steps and procedures, features of construction, combination of elements and arrangement of parts as will be exemplified in the construction set forth and the scope of the invention will be indicated in the claims.

BRIEF DESCRIPTION OF THE DRAWINGS

A fuller understanding of the nature and object of the invention will be had from the following detailed description taken in conjunction with the accompanying drawings in which:

FIG. 2*a* is a fragmentary vertical elevational view on enlarged scale of the plasma torch face depicting one orifice arrangement thereof;

FIG. 3 is a perspective view on enlarged scale with a portion broken away, showing details of the cage structure with a ball bearing to be coated being shown captured within the cage.

Throughout the following description, like parts are used to denote like parts in the drawings.

DESCRIPTION OF THE PREFERRED EMBODIMENTS

Figure 1:
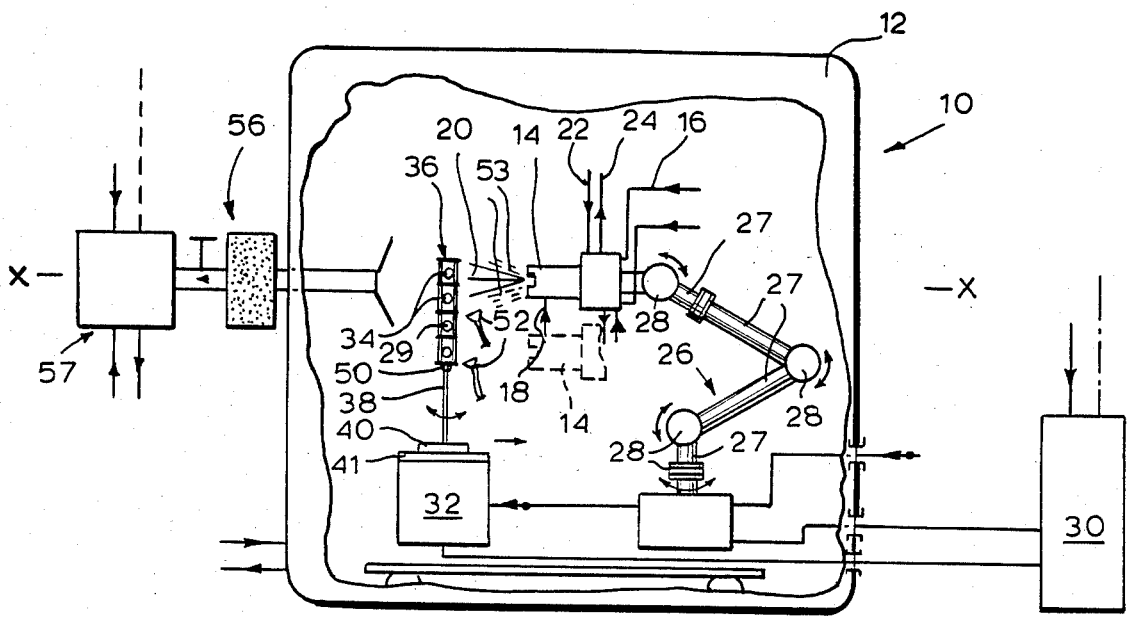
FIG. 1 is a schematic side elevational view depiction of one form of apparatus with which a spherical object can be coated, there being shown a plural cage structure as is used when a corresponding plurality of spherical objects are to be coated.
Figure 2:
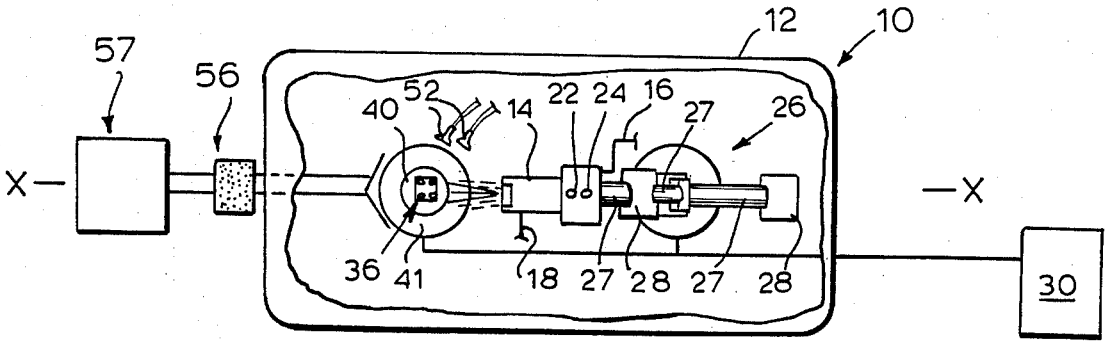
FIG. 2 is a top plan view of the apparatus shown in FIG. 1.

FIGS. 1 and 2 depict one embodiment of apparatus 10 with which a spherical object can be coated in accordance with the invention, the apparatus being generally of a type well known to persons skilled in the art except as modified by the present invention. The apparatus can be enclosed in a housing 12 which can be sealed and evacuated for vacuum spraying as such procedure is understood by those skilled in the art, or same could be effected within an inert gas chamber. Spraying under normal ambient air conditions can be effected within the closed chamber as well and particularly because of the undesirable high noise levels associated with that type of plasma jet spraying operation. The apparatus includes a plasma torch 14 whence the highly heated, ionized jet plasma issues and in which coating material is entrained. The plasma torch 14 has a plasma gas line 16 leading thereto and in which the plasma gas, such as argon, to be ionized is supplied from a source (not shown). Coating material in particulate form thereof is supplied to the torch 14 through supply line 18. The plasma jet issues from the torch in the general longitudinally directed circular section or cone pattern as shown at 20, the issue being from a torch orifice 17 adjacent which the feed of the coating material into the plasma jet can be affected, e.g., from an material flow outlet orifice slightly downstream of the jet issue orifice and from a radially offset location of the jet flow axis, the powder being entrained in a carrier gas such as argon. Water cooling lines 22, 24 are provided to cool the torch. The torch is carried on a suitable machine component, e.g., being mounted on the top of a robot arm assembly 26, the arms 27 of such assembly being articulated and having the joints 28, the arms and the joints being rotatable in the manner indicated with arrows so that multi-dimensional movement of the plasma torch and hence the plasma jet is possible. The robot can, e g., be computer controlled with unit 30. A rotary turntable 32 is used for mounting of the objects to be coated, in this instance, four ball bearings 29 each captured in a respective one of the generally open-sided cages 34 in vertical cage assembly 36. The cage assembly 36 includes a standard 38 to which the cages are attached and a mounting plate 40 which can be removably secured to the turntable rotary bed 41.

As shown in FIG. 3 each cage 34 includes spaced upper and lower plates 42 intervened by a plurality of tubular posts 44, the posts being constructed of small diameter refractory tubing (e.g. thermocouple tubing) to have good thermal insulation for resisting the effect of the high heat of the plasma jet. The posts 44 it will be noted are spaced about the expanse of the plates 42 adjacent the plate edges. The plate and post assembly can be connected together with threaded stringers 46 passing vertically through the posts and plates from top to bottom and there being fasteners such as nuts 48, the stringers extending downwardly through base plate 50 fitted to the top of the standard (FIG. 1). One or more of the stringers can be made to fit loosely in the tubular posts 44 to allow quick removal of one vertical line of posts for access to insert and remove the ball bearings from the cages. The opening or spacing between adjacent posts will be smaller by a certain measure than the ball bearing diameter. Advantageously, two stringers can be threaded through the posts 44 and plates 42 in any given vertical line thereby to rigidize the structure and hold the plates parallel spaced in fixed relation. Where the stringers are loose within the posts, such posts are rotatable about the stringers so that such arrangement contributes to variation between the impact effect on a ball bearing striking such posts and that when a ball strikes a post fixed to a stringer and in consequence the random nature of the movement path the ball follows during coating.

Because the plasma jet is a high temperature flow, it may be necessary to employ measures to prevent overheating of the substrate being coated, in this instance the ball bearings 29. For that purpose cooling gas such as air or an inert gas such as argon can be directed from suitable nozzles 52 into the cages through the open sides thereof and onto the ball bearings. If the substrate becomes overheated, the molten coating material entrained in the plasma jet on striking a ball bearing might instead of spreading and solidifying, flash and vaporize and in any case, not give a well adhered coating. Also, the substrate could deform or melt. The nozzles 52 are situated such as to issue the cooling streams from a location below the cages and are so positioned that each nozzle effectively delivers cooling air to a pair of adjacent cages in the assembly. Also as noted from FIG. 2, the nozzles are spaced at about 90° from the location from whence the plasma jet issues, i.e., about 90° from issue axis X—X. The cooling gas from nozzles 52 because of the nozzle orientation, tends to contribute levitation momentum to the ball bearings, as will be discussed in more detail later. Additional cooling and fan modulation streams 53 can be issued codirectionally of the plasma jet from issue nozzles 54 placed in vertical symmetry about the plasma jet orifice 17 and axis X—X (FIG. 2*a*). Since all of the coating material entrained in the plasma jet and aimed at the object being coated does not strike same and passes by the object and cage structure as an overspray, this highly heated overspray must be exhausted from the housing 12 in manner well known to those skilled in the art and by means shown generally at 56, such means including a filtering or trap system with pumps and/or fans, etc. shown generally at 57.

Further understanding of the method and apparatus of the invention will be had by now describing the coating of ball bearings with suitable coating compositions. Commonly, it is desirable to pretreat the surface of the object to be coated so same may first be subjected to a degreasing operation in known manner and then to an operation to roughen the surface for enhancement of the adherence of the coating thereto. Grit-blasting is representative of a suitable surface roughing treatment. The degreased and surface roughened ball bearings are then placed in the respective ones of the cages in the assembly. The cages of course are opened by removing the stringer 46 and posts 44 from one vertical line, the balls inserted and the removed stringer and posts reinstalled. It is convenient to do this remote from the apparatus after which the assembly can be mounted by fixing the mounting plate 40 to turntable bed 41. The turntable and thus the cage assembly, then can be started rotating at a suitable speed, e.g., about 120 RPM. During that rotational movement, the balls 29 in the cages can assume various positions and movements within the cage space but one where the balls will be moving on the surface of the lower plate 42 of the associated cage. The plasma jet is initiated and directed against the cage assembly to enter the cages and strike the balls. Since it is desirable that the balls be preheated before applying the coating composition thereto, the coating material supply to the plasma torch 14 can be withheld until the ball bearings have been heated to an optimum substrate coating temperature of, e.g., 650° F. This temperature will of course vary depending on the composition of the coating material being applied and of the ball itself. Cooling gas from the nozzles 52 is directed against the cage structure to enter the open cage sides and strikes the balls therein, the gas flow due to its velocity and the positioning of the nozzles also can contribute to lifting of the balls 29 from the lower plates and hence compounding the random movement paths the balls may follow within the cages. Cooling stream flow from nozzles 54 also may be initiated.

Figure 4:
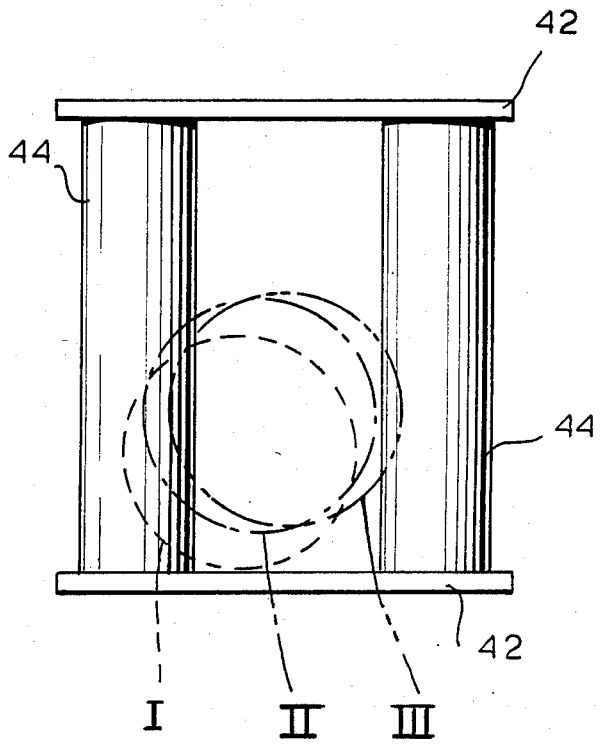
FIG. 4 is an enlarged schematic elevational showing of the cage three-dimensional captive space and shows representative ones of the random positionings a ball bearing may have at a given moment in the random translative and self-rotating paths the ball may follow during the coating operation.

When the preheat temperature has been achieved, the coating feedstock material supply to the plasma jet is initiated to entrain same in the jet. While the particulate form coating composition is resident in the plasma jet in the case of plasma spraying discussed here only a short time, (e.g., 0.1 millisecond), it is caused to melt substantially completely without any significant accompanying vaporization of such material and generally remain molten until it strikes or impinges upon the ball bearing. The plasma jet and the entrained coating composition are high velocity components which in striking the balls produce diverse momentum imparting factors thereto influencing and causing ball bearing movement in the respective capture spaces of the cages. The cooling jets issuing from nozzles 52 to a lesser degree also contribute to the ball bearing movement. In connection with the manner in which the ball bearings during coating follow random travel courses involving translative and rotative movements (that is, ball spin about its own center), no particular theory as to how same takes place is offered. Rather, we have observed that such random travel occurs and as is depicted in FIG. 4 of an observed representative pattern of how the balls move. It will be understood that a ball being coated is lifted up from the cage bottom plate, strikes or impacts on the posts 44 with rebound from such impacts being different where the posts rotate on the stringers than where fixed. The plasma jet and coating compositions blow the balls around in the cage, as does to some extent the cooling streams causing them to self-rotate and generally produce ball movement following no absolutely predictable course. What has been observed though is that the net effect of these random ball movements producing factors presents the ball surface to the plasma jet in such manner that a substantially uniform surface material coating is achieved as to area coverage and that the depth thereof also is reasonably substantially uniform.

FIG. 4 shows three representative random positions of a ball bearing 29 within a cage during the coating operation. Position I shows the ball at one side of the cage where it may have been displaced by the rotation of the cage. It will be understood though that as soon as that cage side rotates in confrontation with the air issuing from nozzles 52 that flow will blow the ball across bottom plate 42 in an opposite direction where it can strike other of the posts and rebound off same in random fashion. Positions II and III reflect ball location when the plasma jet, coating composition flow and cooling air streams are influencing the manner in which the ball moves and spins including being suspended a distance above bottom plate 42 by such influences.

The coating operation continues until a desired depth thereof has been effected and the plasma jet is then terminated while maintaining cage rotation and cooling gas follow until the coated ball bearings and the cage assembly have cooled down to a certain temperature.

During the coating operation, the torch handling device or robot is operated such as to vertically displace the plasma torch 14 vertically between the top of the cage structure and the bottom thereof, that movement being in cyclic form during the coating operation as much as is needed to produce the intended thickness of coating on each ball bearing held in the cage assembly. In an actual operation involving coating four ½ inch diameter ball bearings in the assembly, the balls were coated with an aluminum oxide coating 0.005 inches thick, the torch being vertically displaced through 10 cycles of up and down vertical travel along the stacked cages in the assembly at a speed of 25 mm./sec. with the torch plasma jet orifice being spaced about 120 mm. from the cage assembly and a turntable speed of 120 RPM. Plasma jet temperature at the region thereof striking the cage assembly and ball bearings was about 2,000° F.

Coatings of thicknesses of between 0.004 and 0.015 inches are suitable for most ball bearing applications and depending on the makeup of the coating material. It also will be appreciated that effective coating is controlled by and dependent upon the plasma jet flame shape, cage atmosphere, plasma jet velocity, cooling air velocity and the like. As indicated before the coating composition will be selected on the basis of the purpose for which it is intended that the ball bearings be coated. For example a nickel base alloy composition can be used if it is desired to impart oxidation resistance and chemical attack resistance to the bearings. Aluminum oxide can be used to provide hardness and thermal and electrical insulative properties and zirconia and silicon nitride coatings can be employed to give thermal barrier and wear resistance qualities to a bearing used in high temperature (+600° F.) operating applications.

It also is important and dependent on the type of coating being applied to control the environment in which the plasma jet is operating. In some applications the coating operation desirably is under vacuum condition where the absolute pressure is less than about 200 millibars. On the other hand, coating operation also may be effected in a controlled environment within the housing 12.

While there is disclosed above only some embodiments of the method and apparatus of the invention, it will be appreciated that variations and modifications thereto will occur to those skilled in the art. For example, the cage 34 which in an actual embodiment for coating ½ inch bearings has plates 1 inch square and four posts ⅛ inch in diameter and 1 inch high could be made with circular plates and might have six posts circularly spaced around the plates. Additionally, and depending on the coating composition and substrate materials involved, it is possible to effect the coating without need to use cooling air streams inasmuch as the plasma stream and coating composition streams are sufficient to produce the object levitation and random movement required to produce a substantially uniform desired coating thickness.

What is claimed is:

1. A method for coating a spherical object with a substantially uniformly thick coating of an anti-wear and/or anti-corrosive and/or thermal barrier material which comprises captively enclosing the object in a relatively open sided cage presenting an object free-movement space of defined three-dimensional expanse, rapidly rotating the cage about a fixed vertical axis, directing a highly heated plasma jet stream in which the coating material has been entrained into the rotating cage enclosure to therewith deposit a molten state coating of material on said object, and directing a flow of a cooling gas into the rotating cage enclosure and against the object to prevent overheating of same, the rotary movement of the cage and the velocities of the plasma jet stream and coating material imparting momentum to the object which causes it to undergo translative and rotative movements in random paths including upward lifting thereof within the free-movement space of said cage during the time the object is being coated.

2. The method of claim 1 in which the cooling gas emanates from a location radially spaced from said fixed vertical axis and a distance below said cage whereby the cooling gas flow is dispersed to impart additional levitative momentum force to the object.

3. The method of claim 2 in which the plasma jet issue location is disposed circularly spaced from the cooling gas emanation location.

4. The method of claim 1 in which the plasma jet stream issues from a location radially spaced from said fixed axis in a generally horizontally directed course, and further comprises vertically displacing said issue location in a vertical travel course extending at least between the cage free-movement space upper and lower limits during the time the object is being coated.

5. The method of claim 4 in which cooling gas streams are directed codirectional of the plasma jet and from locations adjacent said plasma jet issue location.

6. The method of claim 4 in which the horizontal distance between the plasma jet issue location and said fixed vertical axis is in the range of about 110 mm. to 120 mm.

7. The method of claim 4 in which the issue location of said plasma jet is vertically displaced at a speed of about 25 mm. per second during the time the object is being coated.

8. The method of claim 1 in which the cage is rotated about said fixed vertical axis at about 120 RPM.

9. The method of claim 1 in which the object is a ball of ferrous based material and the coating material comprises one of an oxide of a metal, ceramic oxides and nickel based alloys.

10. The method of claim 1 in which prior to the coating operation the object is subjected to a grit-blasting operation to roughen its surface and thereby enhance adhesion of molten coating material thereto.

11. The method of claim 1 in which the coating operation is continued until the object has a material coating thereon which is at least 0.004 inch.

12. The method of claim 11 in which the coating operation is continued until the object has a material coating thereon which is in the range 0.004–0.015 inch.

13. The method of claim 1 in which the coating operation is carried out in reduced pressure environment.

14. The method of claim 13 in which the environment pressure is about 200 millibars or less.

15. The method of claim 1 in which a plurality of objects are coated, there being provided a corresponding plurality of open cages, each object being enclosed in an associated one of said cages, the cages being vertically stacked one upon another.

16. The method of claim 15 in which the flow of cooling gas is provided as a separate flow supply for each succeedingly arranged vertical pairing of said cages.

17. The method of claim 1 in which the object is a sphere substantially 0.5 inch in diameter and the object free-movement space is a solid rectangle substantially 0.6 inch square and substantially 1.0 inch long.

18. The method of claim 1 in which the spherical object is a ball bearing.

* * * * *